US005112464A

United States Patent [19]

Tsou et al.

[11] Patent Number: 5,112,464

[45] Date of Patent: May 12, 1992

[54] APPARATUS TO CONTROL REVERSE CURRENT FLOW IN MEMBRANE ELECTROLYTIC CELLS

[75] Inventors: Yu-Min Tsou; Roy L. Hicks, both of Lake Jackson; Harry S. Burney, Jr., Richwood, all of Tex.

[73] Assignee: The Dow Chemical Company, Midland, Mich.

[21] Appl. No.: 539,111

[22] Filed: Jun. 15, 1990

[51] Int. Cl.[5] ..... C25B 9/00

[52] U.S. Cl. ..... 204/265; 204/263; 261/122

[58] Field of Search ..... 204/253, 257, 258, 263, 204/265; 261/122

[56] References Cited

U.S. PATENT DOCUMENTS

| | | | |
|---|---|---|---|
| 3,485,730 | 12/1969 | Virgil, Jr. | 204/98 |
| 4,146,445 | 3/1979 | Cook, Jr. et al. | 204/98 |
| 4,169,775 | 10/1979 | Kuo | 204/98 |
| 4,217,186 | 8/1980 | McRae | 204/98 |
| 4,251,335 | 2/1981 | Bergner et al. | 204/98 |
| 4,272,335 | 6/1981 | Combs | 204/52 R |
| 4,358,353 | 11/1982 | Bommaraju et al. | 204/98 |
| 4,364,806 | 12/1982 | Rogers | 204/98 |
| 4,370,530 | 1/1983 | Wayland | 200/144 B |
| 4,381,230 | 4/1983 | Burney, Jr. et al. | 204/98 |
| 4,389,290 | 6/1983 | Gratzel et al. | 204/128 |
| 4,470,891 | 9/1984 | Moore et al. | 204/98 |
| 4,539,083 | 9/1985 | Samejima et al. | 204/98 |
| 4,561,949 | 12/1985 | Miles et al. | 204/147 |
| 4,643,808 | 2/1987 | Samejima et al. | 204/98 |

FOREIGN PATENT DOCUMENTS

| | | | |
|---|---|---|---|
| 52063893 | 11/1975 | Japan | 204/128 |
| 55008413 | 6/1978 | Japan | 204/128 |
| 60077982 | 10/1983 | Japan | 204/128 |

OTHER PUBLICATIONS

H. S. Burney et al., "Predicting Stunt Currents in Stacks of Bipolar Plate Cells with Conducting Manifolds", 135 *J. Elec. Chem. Soc.* 1609-1612 (Jul. 1988).

R. E. White et al., "Predicting Shung Currents in Stacks of Bipolar Plate Cells", 133 *J. Elec. Chem. Soc.* 485-492 (Mar. 1986).

*Primary Examiner*—John Niebling
*Assistant Examiner*—Kathryn Gorgos
*Attorney, Agent, or Firm*—John L. Wood

[57] ABSTRACT

Methods are disclosed to control reverse current flow in stacks of membrane electrolytic cells during off-line periods. One method includes the introduction of a stripping gas flow to the anolyte solution of the cells during an interruption of normal positive current flow. In another embodiment, reverse current flow is controlled by introducing at least one soluble reducing agent to the anolyte solution during an interruption of normal positive current flow. Also disclosed is a porous sparging apparatus useful in introducing a stripping gas flow to a stack of membrane electrolytic cells.

6 Claims, 4 Drawing Sheets

APPARATUS TO CONTROL REVERSE CURRENT FLOW IN MEMBRANE ELECTROLYTIC CELLS

FIELD OF THE INVENTION

This invention concerns methods to control reverse current flow in membrane electrolytic cells. The invention also concerns an apparatus useful in practicing the methods.

BACKGROUND OF THE INVENTION

There are three types of electrolytic cells primarily used for the commercial production of halogen gas and aqueous alkali metal hydroxide solutions from alkali metal halide brines, a process referred to by industry as a chlor-alkali process. Two of these cells are the diaphragm cell and the membrane cell. The general operation of each cell is known to those skilled in the art and is discussed in Volume 1 of the Third Edition of the *Kirk-Othmer Encyclopedia of Chemical Technology* at page 799 et. seq; the relevant teachings of which are incorporated herein by reference.

In the diaphragm cell, an alkali metal halide brine solution is continually fed into an anolyte compartment containing an anolyte solution where halide ions are oxidized at the anode to produce halogen gas. The anolyte solution, including alkali metal cations contained therein, migrates to a catholyte compartment containing a catholyte solution through a hydraulically-permeable microporous diaphragm disposed between the anolyte compartment and the catholyte compartment. Hydrogen gas and an aqueous alkali metal hydroxide solution are produced at the cathode. Due to the hydraulically permeable nature of the diaphragm, the anolyte solution mixes with the alkali metal hydroxide solution formed in the catholyte compartment.

The membrane cell functions similarly to the diaphragm cell, except that the diaphragm is replaced by a hydraulically-impermeable, cationically-permselective membrane which selectively permits passage of alkali metal ions to the catholyte compartment. The membrane essentially prevents hydraulic permeation of the anolyte solution to the catholyte compartment, except for the alkali metal cations. Therefore, a membrane cell produces alkali metal hydroxide solutions relatively uncontaminated with the alkali metal halide brine.

Membrane cells are typically assembled in "stacks" comprising a plurality of bipolar plate electrodes, the electrodes being assembled in a filter press arrangement wherein each electrode is positioned in a spaced-apart but face-to-face planar relationship with respect to an adjacent electrode. A membrane is positioned between each adjacent bipolar electrode, thereby forming a series of alternating catholyte and anolyte compartments. A stack may also comprise a plurality of membrane cells having monopolar electrodes where the cells are electrically connected in series with respect to each other. Membrane cell stacks generally have common electrolyte and product piping. Membrane cell stacks are known in the chlor-alkali industry and, for example, are described in Volume 6A of *Ullman's Encyclopedia of Industrial Chemistry* (5th Ed. 1986) at pages 399 et seq; the relevant teachings of which are incorporated herein by reference.

During normal operation of a chlor-alkali membrane cell stack, electric current flows from the anode to the cathode in a cell which places the cathode at a negative potential, typically around −1.0 volts versus a mercury/mercuric oxide reference electrode. As used hereinafter, the term "normal positive current flow" refers to the current flow which is impressed by a power source. i.e. a rectifier, external to the cell in order to conduct electrolysis. When normal positive current flow to the cell is interrupted, a membrane cell essentially functions as a battery and may discharge by a flow of electric current in a direction opposite that of the normal positive current flow. As used hereinafter, the term "reverse current flow" refers to the electrical current which flows due to cell discharge after interruption of the normal positive current flow. During reverse current flow, the cathode potential shifts in a positive direction and may rise to a level that leads to cathode corrosion.

It should be understood that the terms "cathode" and "anode" as used herein refer to electrodes having those respective functions during normal cell operation. Normally, reduction is conducted at the cathode, while oxidation is carried out at the anode. However, during reverse current flow, electrode function is reversed from that which prevails during normal operation. For example, although an electrode is a cathode during normal operation, it is an anode in an electrochemical sense during reverse current flow. To avoid potential confusion hereinafter, the terms "cathode" and "anode" refer to electrodes having these respective functions during normal operation, regardless of which direction the electric current is flowing at a given point in time.

In a chlor-alkali cell used to electrolyze, for example, a sodium chloride brine, it is believed that reverse current flow is promoted by electrochemical reactions. Oxidation of adsorbed hydrogen gas on the cathode occurs according to the following reaction:

$$H_2+2OH^- \rightarrow 2H_2O+2e^-$$

while reduction of dissolved chlorine gas, oxygen gas, hypochlorous ion and chlorate ion occurs at the anode according to the following reactions:

$$Cl_2+2e^- \rightarrow 2Cl^-$$

$$4H^+ + O_2 + 4e^- \rightarrow 2H_2O$$

$$OCl^- + H_2O + 2e^- \rightarrow Cl^- + 2OH^-$$

$$ClO_3^- + 3H_2O + 6e^- \rightarrow Cl^- + 6OH^-$$

It is believed that reverse currents promoted by the above chemical reactions are conveyed through electrically conductive cell piping, such as common anolyte and catholyte inlet manifolds (also known in the art as a "header") and related piping associated with a membrane cell stack. See, e.g., H. S. Burney et al., "Predicting Shunt Currents in Stacks of Bipolar Plate Cells with Conducting Manifolds", 135 *J. Elec. Chem. Soc.* 1609-1612 (July 1988) and R. E. White et al., "Predicting Shunt Currents in Stacks of Bipolar Plate Cells", 133 *J. Elec. Chem. Soc.* 485-492 (March 1986); the relevant teachings of which are incorporated herein by reference. The reverse current flow is also believed to be conveyed electrolytically by electrolytes contained in such manifolds and related piping.

It is known in the art that platinum group metals, such as ruthenium, rhodium, osmium, iridium, palladium, platinum, as well as the oxides of the platinum group metals, are useful as electrocatalysts in electrochemical reactions. Electrodes may be fabricated from such electrocatalysts, but a more economical practice is to coat a substrate with a layer of suitable electrocatalysts Electrodes incorporating such electrocatalysts reduce power consumption and are widely used in various forms by industry. Examples of such electrodes appear in U.S. Pat. No. 4,760,041.

One problem associated with development of reverse current flow in membrane electrolytic cells is galvanic corrosion of electrodes, such as cathodes and electrocatalytic coatings thereon. For example, it is believed that as the above-identified chemical reactions proceed and promote reverse current flow in a chloralkali cell, a point is eventually reached where essentially all hydrogen gas available for oxidation, i.e., hydrogen gas that is either adsorbed on the cathode surface or dissolved in the catholyte solution, is consumed. Due to a higher solubility of chlorine gas in the anolyte in comparison to hydrogen gas in the catholyte, a larger amount of chlorine gas is available for reduction at the anode in comparison with hydrogen gas available for oxidation at the cathode. Accordingly, reduction of chlorine-based chemical agents that include, for example chlorine gas, chlorate ion and hypochlorous ion, at the anode continues after depletion of the hydrogen gas with a corresponding oxidation (corrosion) of electrocatalyst coatings, such as ruthenium dioxide, at the cathode. As used herein, the term "galvanic corrosion" refers to the above-described corrosion problem.

Galvanic corrosion can occur shortly after loss of electrical power to the cell stack or during initial start-up of the stack. When normal positive current flow to a membrane cell stack is interrupted due to loss of electrical power or a maintenance problem during operation, cathodes are observed, in many instances, to rapidly corrode. Within a short period of time, i.e., often less than about an hour for a cell stack having 30 or more cells, hydrogen gas adsorbed on the cathode is consumed, and thereafter, a rapid, positive, increase in cathode potential occurs until the cathode surfaces begin to corrode. Galvanic corrosion may occur during initial start-up of the cell stack, but it is generally not as severe as during interruptions in normal cell operation. Galvanic corrosion is likely in cells located toward the center of a membrane cell stack consisting of about ten or more cells, and is particularly severe where the stack consists of about 30 or more cells.

As used hereinafter, the term "corrosion potential" means the equilibrium potential, i.e., an oxidation half cell potential, for the particular material from which the cathode is fabricated. For example, where ruthenium dioxide is used as an electrocatalytic cathode coating, the oxidation half cell reaction may be represented by:

$$4OH^- + RuO_2 \rightarrow RuO_4^{=} + 3O + 2e^- + 2H_2O$$

The equilibrium potential for this oxidation half cell reaction is about +0.1 volts versus a mercury/mercuric oxide reference electrode. As the cathode potential nears this equilibrium potential, corrosion is observed to occur.

Loss of the electrocatalyst is undesirable for commercial operation of membrane electrolytic cells. Catalyst loss increases the cell voltage required for normal operation and thereby results in greater power consumption. In severe cases of corrosion, replacement of the cathode may be required which is also economically undesirable due to the labor and material costs associated with the replacement.

It is also believed that reverse current flow may damage the membrane associated with cells in a stack. Reverse current flow may change the chemical characteristics of the catholyte solution and cause precipitation of chemical species in the membrane.

As a result, it is desirable to develop methods of controlling reverse current flow in membrane electrolytic cells while the cells are out of operation due to, for example, loss of electrical power, process maintenance problems or initial cell start-up. An object of the present invention is to control reverse current flow and its attendant problems.

SUMMARY OF THE INVENTION

The above objects are achieved in one aspect by a method of controlling reverse current flow in a stack of electrolytic membrane cells during interruptions in normal positive current flow. Each membrane cell comprises a cathode in contact with a catholyte solution and an anode in contact with an anolyte solution. The catholyte solution and the anolyte solution are separated by a hydraulically impermeable ion-exchange membrane The anolyte solution contains reducible chemical agents present during normal cell operation that are capable of promoting a reverse current flow during interruptions in the normal positive current flow. The method comprises introducing a stripping gas flow into the anolyte solution during interruptions of the normal positive current flow, the stripping gas flow being at a rate sufficient to adequately remove the reducible chemical agents in order to substantially prevent the reverse current flow.

The method of the preceding paragraph is optionally combined with (1) flushing the anolyte compartments with an alkali metal halide brine solution and (2) providing a residual positive current flow through the cell. The preceding options may be employed singularly or in combination with each other in a manner sufficient to substantially prevent the reverse current flow.

A second aspect is a method to control reverse current flow in a stack of electrolytic membrane cells during interruptions in normal positive current flow. The membrane cell stack corresponds to the description given with respect to the first aspect of the invention. The method comprises introducing an amount of a soluble reducing agent to the anolyte solution during interruptions in the positive current flow, the amount of soluble reducing agent being sufficient to chemically react with the reducible chemical agents and substantially prevent the reverse current flow.

A third aspect is a sparging apparatus for distributing a stripping gas flow to at least one anolyte compartment in a stack of membrane electrolytic cells to control reverse current flow. The apparatus comprises a porous conduit having an inlet end and a closed end. The porous conduit is adapted for installation in an anolyte inlet manifold supplying an aqueous alkali metal halide brine solution to the cell stack. The porous conduit is provided with means for securing the porous conduit inside the manifold and means for connecting the inlet end of the porous conduit to a source of the stripping gas flow.

Figure 1:
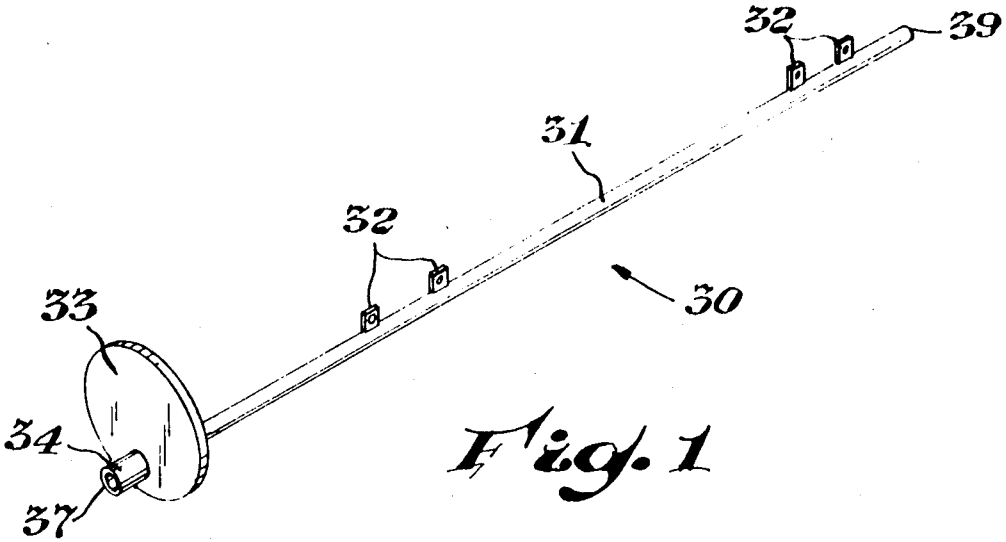
FIG. 1 is an isometric view of an embodiment of the sparging apparatus disclosed herein.

Hereinafter, the drawings are referred to in an abbreviated form, such as FIG. 1.

DETAILED DESCRIPTION OF THE PRESENT INVENTION

The methods of the present invention are capable of controlling reverse current flow in a membrane electrolytic cell. By the term "controlling reverse current flow", it is meant to substantially reduce the reverse current flow which would otherwise be present during periods where normal positive current flow is interrupted. A substantial reduction in the reverse current flow minimizes problems, such as galvanic corrosion, which are associated with reverse current flow in membrane cells.

One method for controlling reverse current flow in membrane electrolytic cells, such as a chlor-alkali cell, includes introducing a stripping gas flow into the anolyte solution of such cells. The stripping gas flow removes dissolved chlorine gas and oxygen gas from the anolyte solution and, thereby, reduces the amount of such gases which are capable of being reduced at the anode to promote reverse current flow.

The dissolved chlorine gas and oxygen gas are hereinafter referred to as "reducible chemical agents". Also included as reducible chemical agents are hypochlorous ion and chlorate ion which are believed to be in equilibrium with dissolved chlorine gas according to the following reversible reactions:

$$Cl_2 + H_2O \rightleftharpoons HOCl + H^+ + Cl^-$$

$$HOCl \rightleftharpoons H^+ + OCl^-$$

$$2HOCl + OCl^- \rightleftharpoons ClO_3^- + 2H^+ + 2Cl^-$$

It is believed that removal of dissolved chlorine gas by the stripping gas flow disturbs the equilibrium and rapidly converts hypochlorous ion to additional chlorine gas. Conversion of chlorate ion to chlorine gas proceeds at a much slower rate. The additional chlorine gas may then be removed by the stripping gas flow. Thus, the term "reducible chemical agent" refers to any chemical species which is capable of being reduced at the anode to promote reverse current flow and that may be removed, directly or indirectly, from the anolyte solution by the stripping gas flow. Reducible chemical agents also include chemical species removed by chemical reaction with a soluble reducing agent as described hereinafter. The reducible chemical agents described herein are produced or are inherently present in the anolyte solution during normal cell operation.

The stripping gas may be selected from any gas which is substantially incapable of being reduced at the anode. Suitable stripping gases include chemically inert gases such as noble gases, i.e., argon, helium, neon, and so on. Also, suitable as a stripping gas are nitrogen, carbon dioxide, sulfur dioxide and air. A preferred stripping gas is nitrogen due to its inertness and low cost. Air is suitable for use as a stripping gas, despite having a minor portion of oxygen gas therein, due to a low solubility of oxygen gas relative to chlorine gas in the anolyte solution. As such, air may be used in a two step process. In an initial step, a major amount, i.e. preferably greater than about 50% by weight, of the chlorine gas is removed by using air as the stripping gas. Thereafter, nitrogen may be used to remove a desired amount of the remaining dissolved oxygen gas and chlorine gas. This two step process reduces the amount of nitrogen gas used when compared with use of nitrogen gas alone.

The stripping gas flow is introduced by any means allowing for a substantially uniform distribution of the stripping gas flow to the cell stack. Although the stripping gas could be introduced only to a portion of the cells, it is preferred to distribute the gas flow uniformly to provide maximum protection against galvanic corrosion. It is also preferred to introduce the stripping gas flow near the bottom of the anolyte compartment, in order to maximize contact between the anolyte solution and the stripping gas flow to obtain a more efficient stripping effect.

Accordingly, the stripping gas may be directly introduced to the anolyte compartment of a cell, or indirectly through common piping or other process equipment, such as an anolyte recycle tank. The anolyte recycle tank is typically used in a chlor-alkali process to separate chlorine gas from spent anolyte solution prior to recycling a portion of the spent anolyte solution back to the cell stack. The stripping gas flow could be introduced at a point subsequent to the anolyte recycle tank, for example discharge piping associated with pumps used to recycle spent anolyte solution back to the cell stack. The term "anolyte inlet piping" as used hereinafter refers to such common piping or process equipment. It is preferred to introduce the stripping gas through the anolyte inlet piping to facilitate distribution of the stripping gas to a maximum number of cells.

One method of introducing the stripping gas flow is to sparge the stripping gas into the anolyte inlet piping using commercially available sparging units, such as pipeline sparge units identified as Models 7615, 7616 and 7617 and manufactured by the Mott Metallurgical Corporation, or a similar type of device. A preferred method is to introduce the stripping gas into the anolyte inlet piping, such as an anolyte inlet manifold, by way of the sparging apparatus described hereinafter. Other methods for introducing the stripping gas flow in practicing the method of the present invention will become apparent to those skilled in the art upon reading this description.

The stripping gas flow is introduced to the anolyte solution of a cell at a rate sufficient to reduce the amount of reducible chemical agents therein and substantially prevent reverse current flow. The rate of stripping gas flow is suitably from about 0.1 to about 3000 standard liters per minute for each cubic meter of the anolyte solution. The rate is desirably from about 1 to about 500 and preferably from about 50 to about 200 standard liters per minute for each cubic meter of the anolyte solution. A rate below about 0.1 standard liters per minute for each cubic meter of the anolyte solution is generally insufficient to prevent formation of reverse current flow. A rate above about 3000 standard liters per minute for each cubic meter of the anolyte solution is not economical or necessary to achieve acceptable results.

The stripping gas flow may be initiated either just prior to or immediately upon commencing an interruption in the normal positive current flow. Interruptions in the normal positive current flow may be due to either an unplanned power loss or maintenance problem, or merely due to a need to conduct repairs to the cell stack. In the event of an interruption, the gas flow is preferably initiated prior to or upon loss of normal positive current flow to the cell. The stripping gas flow may also be used during initial start-up of a cell stack. In this case, the stripping gas flow is preferably initiated at the time the anolyte compartments are filled with the brine solution being electrolyzed. In any event, the stripping gas flow is suitably initiated prior to the cathode reaching its corrosion potential and preferably prior to reaching a point about 200 millivolts negative with respect to the corrosion potential.

The stripping gas flow is advantageously maintained until resuming a normal positive current flow to the cell stack. Generally, an aqueous alkali metal halide brine solution is circulated through the anolyte compartments of such membrane cells during off-line periods to mix the anolyte solution contained therein. Although most of the chlorine-based reducible chemical agents, as previously defined, are removed within from about 2 to about 6 hours after initiating the stripping gas flow, it is inevitable that dissolved oxygen gas will be added to the anolyte compartments by the circulated brine solution. As such, the stripping gas flow is maintained until the normal positive current flow is resumed, in order to remove oxygen gas introduced to the anolyte solution by the circulated brine solution. However, it is possible to discontinue the stripping gas flow, after removal of chlorine-based reducible chemical agents, for up to about 24 hours before cathode corrosion becomes a problem. Reverse current flow is not as readily promoted by dissolved oxygen gas alone.

Use of a stripping gas flow is optionally and preferably combined with flushing the cell anolyte compartments with an aqueous alkali metal halide brine solution. Flushing is advantageously conducted by circulating an alkali metal halide brine through the cells during interruptions in normal positive current flow. The brine solution assists with removal of the reducible chemical agents by diluting their concentration in the anolyte solution.

The alkali metal halide brine solution is introduced to the anolyte solution at a rate, when combined with the stripping gas flow, that is sufficient to substantially prevent reverse current flow. In general, suitable results are obtained where the rate is from about 5 to about 300 liters per minute for each cubic meter of anolyte solution in the cell. The rate desirably is from about 10 to about 50 and preferably is from about 15 to about 40 liters per minute for each cubic meter of anolyte solution.

The pH of the alkali metal halide brine is suitably from about 2 to about 12, but preferably is from about 2 to about 6. A pH of between about 2 and about 6 hinders conversion of dissolved chlorine gas to ionic species, such as hypochlorous ion and chlorate ion.

The concentration of alkali metal halide in the brine solution is not critical and may be in a range of from about 10% up to saturation for the alkali metal halide employed, such as about 26% by weight for a sodium chloride brine solution at 20° C. However, generally the alkali metal halide concentration for the brine being electrolyzed in a membrane cell is limited by specifications set for the particular membrane employed in the cell. Accordingly, care should be taken not to deviate from specifications set by the membrane manufacturer. The alkali metal halide brine solution used for flushing the anolyte compartments is most conveniently the same brine solution being electrolyzed in the cells.

The alkali metal halide brine solution may be introduced directly to the anolyte compartments of each cell, but is more conveniently introduced indirectly by pumping the brine solution into the anolyte inlet piping to facilitate distribution of the brine solution to a maximum number of cells. As stated above, the alkali metal halide brine solution preferably corresponds to the brine being electrolyzed in the cell stack. As such, the brine flow to the cells is simply maintained after termination of the normal positive current flow. If another brine solution is employed having a composition different than the brine being electrolyzed, the brine used to flush the anolyte compartments is preferably introduced to the anolyte solution contemporaneously with the stripping gas flow.

The stripping gas flow is optionally and preferably combined with the use of cathodic protection. As used herein, the term "cathodic protection" refers to a method which provides a residual electric current flow through the cell during interruptions in the normal positive current flow. By the term "residual positive current flow", it is meant a substantially reduced amount of electric current flowing in the same direction as the normal positive current flow. A residual positive current flow may be provided by use of an auxiliary rectifier sufficient to supply a small direct current flow, such as at least about 0.5 amperes per square meter of projected cathode surface area, after loss of the principal power source to the cell stack. The term "projected electrode surface area" refers to the geometrical surface area of the electrode. The use of residual currents for cathodic protection is described in U.S. Pat. No. 4,169,775, the teachings of which are incorporated herein by reference.

The residual positive current flow complements the stripping gas flow with respect to controlling reverse current flow. In general, the residual positive current flow is advantageously from about 0.5 to about 100 amperes per square meter of projected cathode surface area. The residual positive current flow is desirably from about 1 to about 80 and preferably from about 10 to about 40 amperes per square meter of projected cathode surface area.

Cathodic protection is suitably initiated before the cathode reaches its corrosion potential. To receive maximum protection from galvanic corrosion, it is preferred to begin cathodic protection contemporaneously with the stripping gas flow and at a time just prior to or upon commencement of an interruption in the normal positive current flow. Upon reducing the concentration of reducible chemical agents in the anolyte solution to less than about 100 parts per million ("ppm") on a weight basis, the residual current flow may be discontinued while maintaining the stripping gas flow until the cell stack is re-energized.

In practicing the invention, the introduction of a stripping gas flow to the cell anolyte compartments is preferably combined with both flushing the anolyte compartments with an alkali metal halide brine solution and providing a residual positive current flow through the cells, as each of these techniques is described hereinabove.

Another aspect of the invention comprises introducing a soluble reducing agent to the cell anolyte solution in an amount sufficient to substantially prevent reverse current flow. In a preferred embodiment, this method is combined with cathodic protection and flushing the anolyte compartments with an alkali metal halide brine solution as previously described herein. The use of soluble reducing agents is described hereinafter.

A soluble reducing agent is a compound capable of chemically reacting with the reducible chemical agents and, thereby, acts to decrease their concentration in the cell anolyte solution. Suitable soluble reducing agents are compounds which will not damage the cation-selective characteristic of the membrane material and which are soluble in the anolyte solution in order to be readily dispersed therein. Preferred soluble reducing agents are alkali metal salts of weak acids wherein the anion is selected from sulfite, phosphite, hypophosphite, dithionite, thiosulfate, pyrosulfite, and mixtures thereof. Examples of preferred soluble reducing agents are sodium sulfite, sodium dithionite and sodium thiosulfate. Soluble reducing agents may be used singularly or in combination with other soluble reducing agents.

The amount of soluble reducing agents introduced to the cell anolyte solution is sufficient to chemically react with a sufficient amount of the reducible chemical agents in an adequate amount of time, in order to substantially prevent reverse current flow. In general, the amount of soluble reducing agents introduced is sufficient to yield a soluble reducing agent concentration of from about 0.1 to about 10 grams per liter in the anolyte solution. The amount introduced is preferably capable of yielding a soluble reducing agent concentration of from about 1 to about 6.5 grams per liter of the anolyte solution. A soluble reducing agent concentration less than about 0.1 grams per liter is generally insufficient to provide adequate protection against corrosion. A concentration greater than about 10 grams per liter is not necessary to obtain satisfactory results. However, the upper limit on the soluble reducing agent concentration may be limited by the choice of membrane employed in the cell. It is believed that membrane performance may be adversely affected at concentrations above about 10 grams per liter resulting in a lower current efficiency for the cell. It is important that the anolyte solution attain the above soluble reducing agent concentrations within about two hours or less where the membrane cell stack consists of 30 or more cells. For smaller cell stacks, the time necessary to attain the specified soluble reducing agent concentration is not as critical.

The soluble reducing agent may be directly introduced to the anolyte solution in solid form, but it is generally more convenient and, therefore, preferred to dissolve the soluble reducing agent in an aqueous solution and thereafter introduce the aqueous solution to the cell. It is most preferred to dissolve the soluble reducing agent within the alkali metal halide brine solution used to flush the anolyte compartments as previously described herein.

Where soluble reducing agents are introduced to the anolyte solution by an aqueous solution, the soluble reducing agent concentration and flow rate are selected such that the soluble reducing agent concentration in the anolyte solution reaches about 0.1 to about 10 grams per liter within about two hours or less for a stack of 30 or more cells. Generally, a soluble reducing agent concentration in the aqueous solution of from about 0.1 to about 10 grams per liter provides good results when operating at a flow rate of from about 15 to about 40 liters per minute for each cubic meter of anolyte solution. Those skilled in the art will realize that an aqueous solution having a higher concentration of soluble reducing agents will not require as great a flow rate to achieve similar results. Conversely, a lower concentration would require a higher flow rate to obtain similar results.

The soluble reducing agents may be introduced to the cell anolyte solution either just prior to or upon commencement of an interruption in normal positive current flow to the cell stack. In a preferred embodiment, the soluble reducing agents are introduced after removing a major amount of the reducible chemical agents, such as greater than about 50% by weight, in an initial step. The initial step combines cathodic protection and flushing of the cell anolyte compartments with an alkali metal halide brine solution as those techniques are previously discussed herein. Thereafter, the soluble reducing agents may be introduced to the alkali metal halide brine solution. By using this procedure, the amount of soluble reducing agents necessary to achieve acceptable results is minimized and potential damage to the membrane through use of a high soluble reducing agent concentration is avoided.

The methods disclosed herein are suitable to control reverse current flow in membrane cell stacks comprising at least about ten membrane cells. The methods are particularly well suited to control galvanic corrosion in a stack of 30 or more membrane cells and preferably more than about 40 cells. As previously mentioned, galvanic corrosion generally increases in severity as the number of cells in a stack is increased, particularly with respect to cells at or near the center of the stack.

A further aspect of the invention is a sparging apparatus for conveying the stripping gas flow to the anolyte compartments of a membrane cell stack. The sparging apparatus is adapted for installation in an anolyte inlet manifold supplying anolyte solution to the cell stack.

Figure 2:
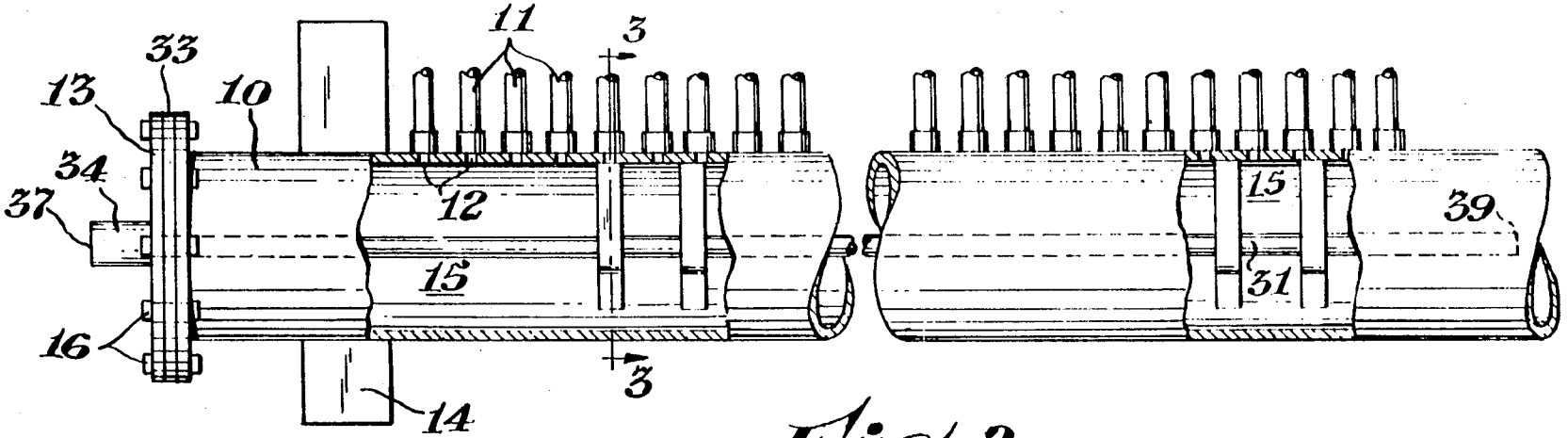
FIG. 2 is a plan view, partially in section, which depicts the sparging apparatus, as illustrated in FIG. 1, assembled in an anolyte inlet manifold associated with a membrane cell stack.
Figure 3:
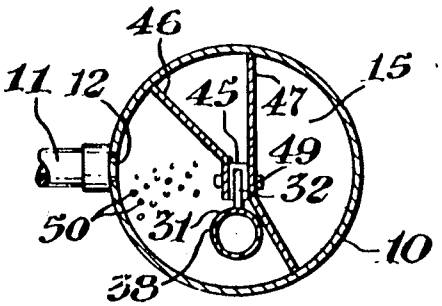
FIG. 3 is a cross-section view of FIG. 2 illustrating placement of the sparging apparatus within the anolyte inlet manifold.

The sparging apparatus is depicted in FIGS. 1, 2 and 3. Referring now to FIG. 1, the apparatus 30 comprises a hollow, porous conduit 31. The porous conduit 31 has an inlet end 37 and a closed end 39. The porous conduit has support tabs 32 attached thereto which provide a means for securing the porous conduit inside an anolyte inlet manifold. Also attached to the porous conduit is a plate 33 providing an additional means for securing the conduit inside the manifold. A fitting 34, such as a pipe nipple, provides means for connecting the apparatus 30 to a stripping gas source to facilitate a stripping gas flow through the inlet end 37. The inlet end 37 extends outside the anolyte inlet manifold 10 as shown in FIG. 2.

The sparging apparatus 30 is fabricated from materials resistant to attack from chemical species present in the cell anolyte solution. For chlor-alkali cells, the materials of construction are suitably selected from metals which are highly corrosion resistant in an acidic medium, such as "valve metals" employed in the chlor-alkali industry. Examples of corrosion-resistant metals are titanium, tantalum, zirconium, niobium, tungsten, or alloys thereof. Also suitable are non-metallic materials, such as halogenated hydrocarbon polymers like polytetrafluoroethylene, perfluorinated ethylene-propylene copolymer are perfluorinated ethylene-vinyl ether copolymer. A preferred material of construction is titanium metal.

FIG. 2 depicts the sparging apparatus 30, as previously described in reference to FIG. 1, installed within an anolyte inlet manifold 10. The anolyte inlet manifold 10 is supported by support means 14 and has a plurality of anolyte inlet tubes 11 attached thereto. The anolyte inlet tubes 11 convey a mixture of fresh brine and recycled anolyte solution to a respective anolyte compartment in a cell stack during normal operation. The anolyte inlet tubes 11 have inlet ports 12 which receive fresh brine solution contained in chamber 15. The sparging apparatus 30 is secured, in part, by a manifold end plate 13 which is placed adjacent to plate 33. The manifold end plate 13 and plate 33 are secured to anolyte inlet manifold 10 by a plurality of fastener means 16, such as bolts.

Referring now to FIG. 3, the porous conduit 31 is shown installed inside anolyte inlet manifold 10. Means for securing the porous conduit is provided by bracket spacing means 45, 46 and 47 which preferably rest against, but are not rigidly fastened to an interior surface of the anolyte inlet manifold 10. If the bracket spacing means 45, 46 and 47 are not rigidly fastened, the sparging apparatus 30 of FIG. 1 with the bracket spacing means attached thereto, may be easily installed and removed from the anolyte inlet manifold by removing end plate 13 and fastener means 16 and sliding the sparging apparatus in or out of the anolyte inlet manifold. The bracket spacing means 45, 46 and 47 maintain the porous conduit 31 in a desired position within the anolyte inlet manifold. The porous conduit 31 is secured to the bracket spacing means 45, 46 and 47 by fastener means 49. The bracket spacing means 45, 46 and 47 and fastener means 49 are suitably fabricated of materials, as previously described, which are suitable for constructing the sparging apparatus 30. If the anolyte inlet manifold 10 is constructed of metal, the bracket spacing means 45, 46 and 47 are preferably constructed of the non-metallic materials, previously described, in order to electrically isolate the porous conduit 31 from the interior surface of the anolyte inlet manifold. Electrical isolation of the porous conduit is desirable to minimize the possibility of the sparging apparatus as being a transmission medium for reverse current flow.

During interruptions of normal positive current flow to the cell stack, a stripping gas contained within the porous conduit 31 is forced under a positive pressure through perforations 38 to form bubbles of the stripping gas 50. The stripping gas must be at a pressure greater than the pressure of fluid contained within the anolyte inlet manifold 10 in order to maintain a flow of stripping gas through the sparging apparatus 30. Anolyte solution contained within the chamber 15 of the anolyte inlet manifold 10 is forced under pressure into anolyte inlet tubes 11 which normally convey anolyte solution to the anolyte compartments of a membrane cell stack. Flow of the alkali metal halide brine solution into the anolyte inlet tubes 11 also assists with conveying the stripping gas bubbles 50 to the anolyte compartments to remove reducible chemical agents therein.

The porous conduit 31 has an inlet end 37 which is adapted with fitting 34 to receive the stripping gas from the stripping gas source and a closed end 39 to maintain gas pressure therein. The shape of the porous conduit is not critical, so long as it may be installed within the inlet manifold 10 and will distribute the stripping gas to a maximum number of the cells at a rate, as previously described, which is sufficient to substantially prevent reverse current flow. An example of a suitable shape for the porous conduit is a cylindrical tube which extends for substantially the length of the anolyte inlet manifold employed.

The porous conduit 31 has a plurality of perforations 38, such as substantially circular drilled holes, that are provided to allow the stripping gas within the porous conduit to form bubbles 50 which are then conveyed to the cells. The perforations 38 are suitably located in an arrangement sufficient to provide the rate of stripping gas flow as previously described. In a preferred embodiment, the perforations 38 are evenly distributed lengthwise along the porous conduit, the distribution essentially corresponding to the location of the inlet ports 12 on the inside surface of the anolyte inlet manifold 10.

The size and shape of the perforations 38 are preferably selected to maximize the surface area for contact between the stripping gas and the anolyte solution. Smaller perforations provide a larger surface area for contact between the stripping gas and the anolyte solution in comparison to larger perforations. However, extremely small perforations may be easily plugged by alkali metal halide salt crystals which may form or be present in the anolyte inlet manifold. For brine solutions which are close to saturation with respect to the alkali metal halide salt employed, it is possible for such crystals to form due to vaporization of water by the stripping gas flow. In general, acceptable results are obtained by using substantially circular holes having a diameter of from about 0.5 millimeters to about 5 millimeters. However, any foraminous conduit capable of passing the stripping gas flow at the rate previously described herein will suffice.

SPECIFIC EMBODIMENTS OF THE INVENTION

The following examples illustrate the present invention and should not be construed, by implication or otherwise, as limiting the scope of the appended claims. All parts and percentages are by weight and all temperatures are in degrees Celsius (°C.) unless otherwise indicated hereinafter.

EXAMPLE 1

Figure 4:
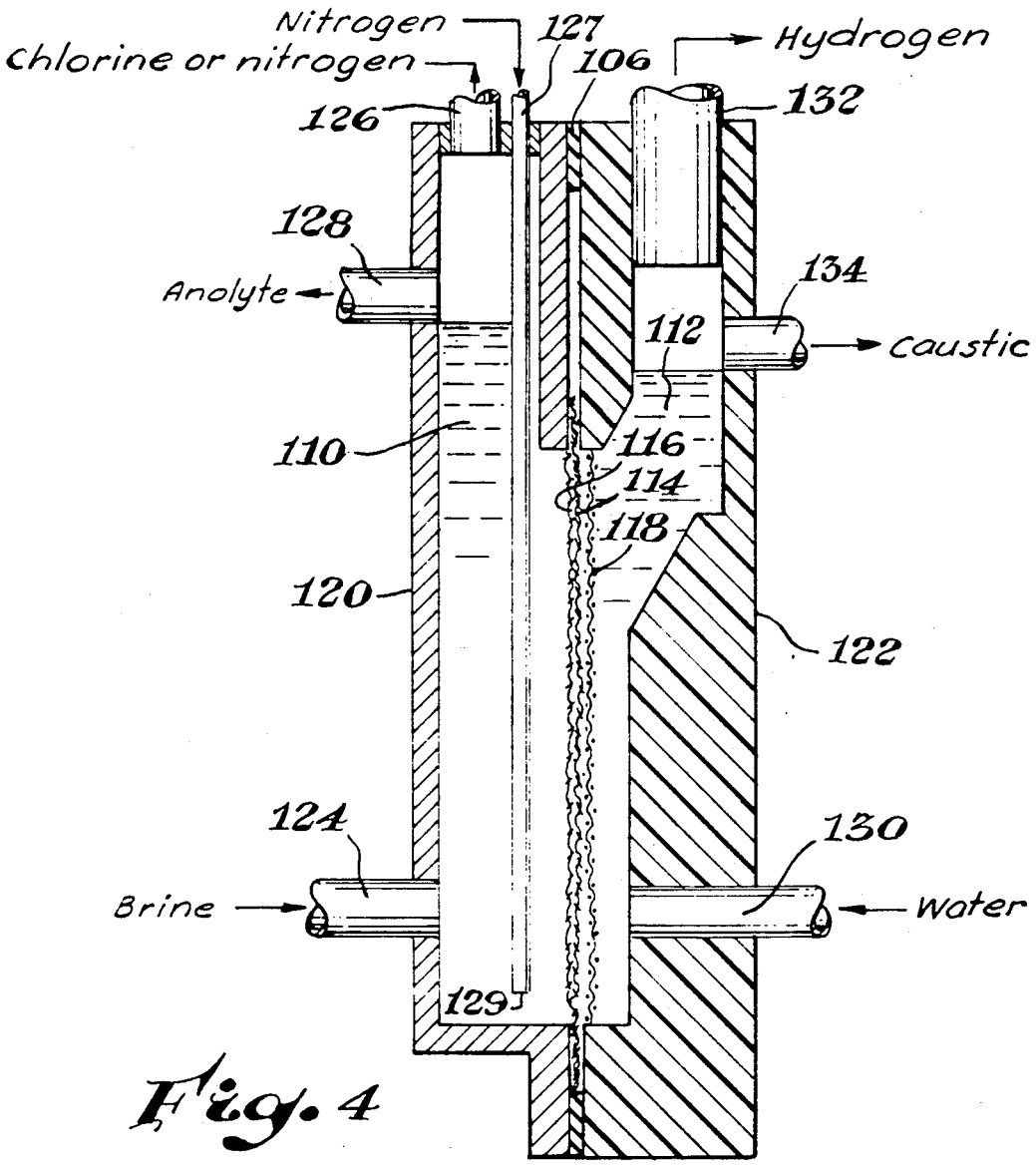
FIG. 4 is a cross-section view of an electrolytic cell described in Example 1.

Use of a Stripping Gas Flow to Control Reverse Current Flow and Cathode Corrosion in Electrolytic Cells Reverse current flow is simulated in an electrolytic cell by connecting two electrolytic cells in an electrical circuit. FIG. 4 depicts the electrolytic cells employed in the simulation. The cells have an anolyte compartment 110 and a catholyte compartment 112. The two compartments are separated by a vertically disposed, permselective cation exchange membrane 114 obtained from the Ashai Glass Company and marketed under the trademark Flemion®. The membrane is sealed between anode frame 120 and cathode frame 122 by gaskets (not shown) located on either side of membrane 114. Gasket 106 represents a gasket sealing means used between anolyte compartment 110 and catholyte compartment 112. Near membrane 114 is disposed a vertical, parallel, flat-shaped cathode 118. The cathode 118 is a nickel expanded mesh substrate coated with a substantially homogeneous coating of ruthenium dioxide and nickel oxide. The cathode coating is produced by substantially following methods taught in U.S. Pat. No. 4,760,041. Anode 116 is a titanium expanded mesh sheet having a titanium dioxide and ruthenium dioxide coating thereon. The anode coating is produced by substantially following methods taught in U.S. Pat. No. 3,632,498.

Mechanical supports and direct current electrical connections for anode 116 and cathode 118 are not shown in the figure, as they are not critical to illustrate the invention and would only obscure the drawing. In general, the anode 116 and cathode 118 are supported by respective studs passing through cell walls associated with anode frame 120 and cathode frame 122. Direct current electrical connections are attached to the studs to provide electrical current necessary to conduct electrolysis. The electrical current passing through the cell is regulated by use of a rectifier sufficient to maintain a constant current density per unit of projected electrode surface area, measured as amperes per square meter ($A/m^2$), during normal operation of the cell.

Flow regulating devices, also not shown, are employed to maintain constant electrolyte flow to the cell. The cell is equipped with a glass immersion heater, also not shown, which maintains the cell at an elevated temperature, generally at about 90° C.

The cell frames are fabricated from two types of materials depending upon the cell environment to which they are subjected. The anolyte frame 120 is made of titanium metal which is resistant to attack under conditions present in the anolyte compartment 110. The catholyte frame 122 is made of acrylic plastic which is resistant to attack under conditions present in the catholyte compartment 112.

The anolyte frame 120 has a port 124 for introducing fresh brine to the anolyte compartment, a port 128 for removing spent anolyte solution from the anolyte compartment and a port 126 for removing chlorine gas or a nitrogen stripping gas from the anolyte compartment. Nitrogen gas used as a stripping gas is introduced to the anolyte compartment 110 through the anolyte frame 120 by use of a polytetrafluoroethylene tube 127. The polytetrafluoroethylene tube 127 has an outside diameter of about 3 millimeters and an outlet 129 through which the nitrogen gas is introduced to the anolyte compartment. The polytetrafluoroethylene tube extends downward into the anolyte compartment such that the outlet 129 is about 0.5 centimeters from the bottom thereof.

The catholyte frame 122 has a port 130 for introducing water to the catholyte compartment, a port 134 for removing caustic, i.e., aqueous sodium hydroxide, from the catholyte compartment and a port 132 for removing hydrogen gas from the catholyte compartment.

Figure 5:
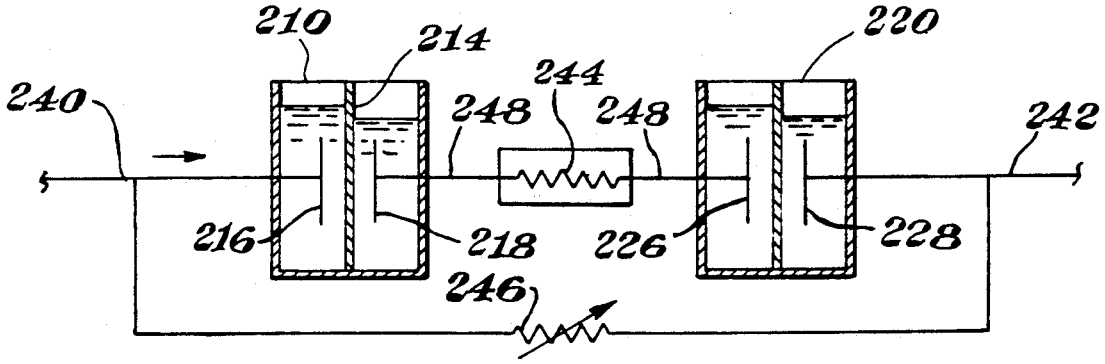
FIG. 5 is a circuit diagram illustrating a method used to simulate reverse current flow which is described in Example 1.

To simulate reverse current flow, two of the membrane electrolytic cells described in the preceding paragraphs are connected in an electrical circuit as shown in FIG. 5. Each cell has a membrane 214. The cathode 218 of a first cell 210 is connected to the anode 226 of a second cell 220 by use of wires 248 and a shunt resistance 244. The shunt resistance 244 is a copper bar having a known resistance of 0.001 ohms. The shunt resistance is used to accurately determine the amount of current flowing through the cells. To complete an electrical circuit, the anode 216 of the first cell 210 and the cathode 228 of the second cell 220 are connected to an external power source (not shown). A 40 ohm resistance 246, provided by a variable resistance box, is placed between the anode 216 of the first cell 210 and the cathode 228 of the second cell 220 as shown in FIG. 5. The 40 ohm resistance simulates reverse current discharge paths, such as the cell piping and electrolyte contained therein, in a cell stack. During normal cell operation, the 40 ohm resistance is not connected to the electrical circuit at points 240 and 242 Therefore, the external power source impresses a normal positive current flow from point 240 to point 242 through the electrolytic cells. The same result may be achieved by connecting the 40 ohm resistance as shown in FIG. 5 and positioning an open switch (not shown) between the 40 ohm resistance 246 and either of points 240 or 242.

The two electrolytic cells are initially operated to produce chlorine gas, hydrogen gas and aqueous sodium hydroxide solution by electrolyzing a sodium chloride brine. The cells are connected in series, as shown in FIG. 5, except the 40 ohm resistance is not connected during electrolysis. The operating conditions for both cells are a current density of 2900–4100 $A/m^2$, a cell voltage of about 3.05–3.30 volts, a temperature of 90° C., a catholyte sodium hydroxide concentration of 26–35% by weight and an anolyte sodium chloride concentration of 17–22% by weight. The brine supplied to the cells has a sodium chloride content of 25% by weight.

After reaching steady state conditions, normal positive current flow to both electrolytic cells is terminated and the 40 ohm resistance 246 is connected as shown in FIG. 5 within 45 seconds. After the 40 ohm resistance is connected, nitrogen gas at a positive pressure of about 4 kPa gauge pressure is introduced into the anolyte compartments of both cells at a steady flow rate of 340 cubic centimeters per minute, or in other terms, 2300 standard liters per minute for each cubic meter of anolyte solution in the cell. The potential of cathode 218 is measured continuously after termination of the normal positive current flow using a Kaye Data Logger Model RP-1D in conjunction with a Hewlett Packard Scientific Computer Model HP 9845A and a mercury/mercuric oxide reference electrode. The results are given in graphical form in FIG. 6 and are represented by the curve identified with squares.

COMPARATIVE EXAMPLE A

Figure 6:
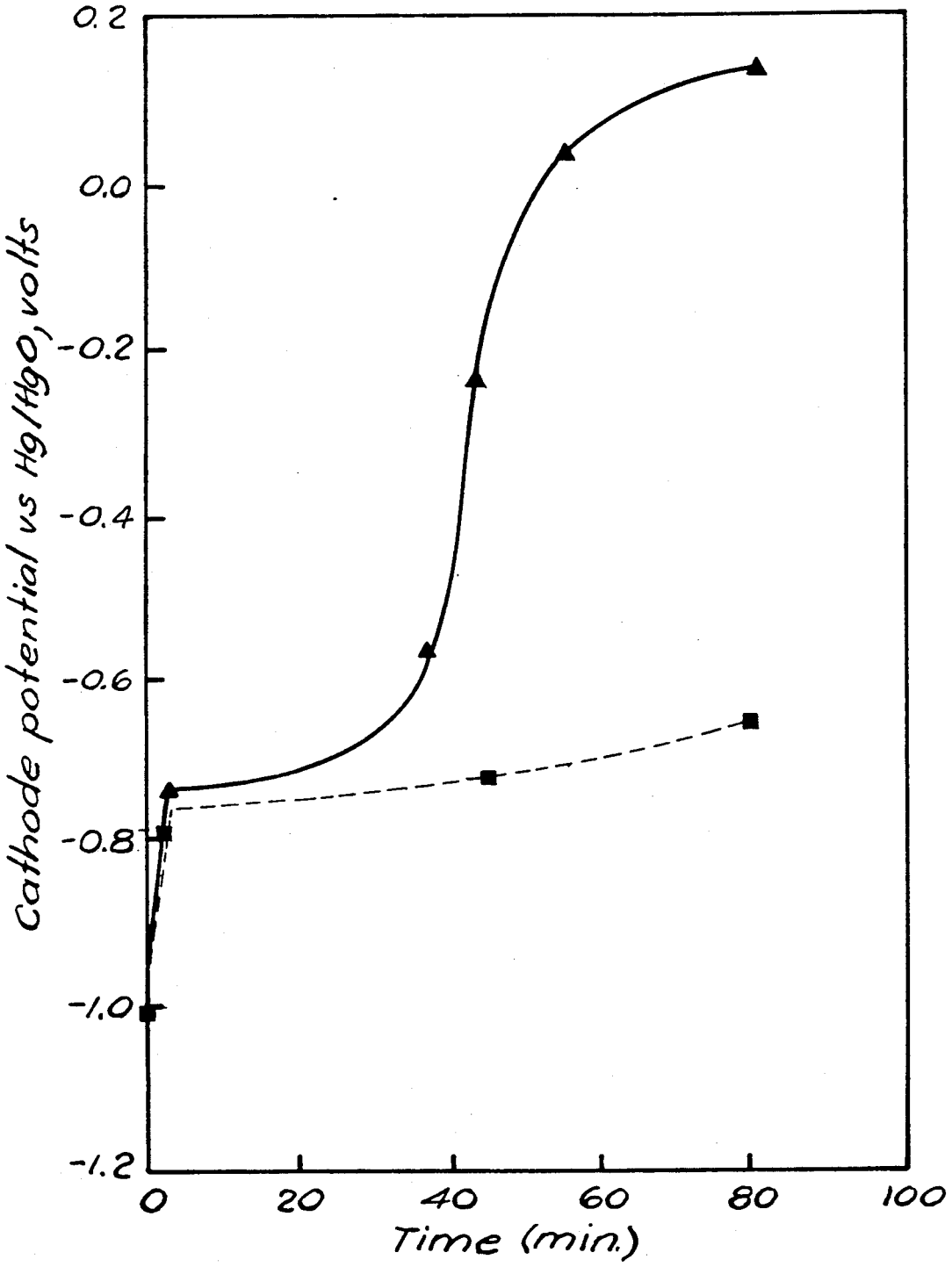
FIG. 6 is a graph of cathode potential, as measured in volts using a mercury/mercuric oxide reference electrode, versus time, in minutes, for results obtained by Example 1 and Comparative Example A. The curve identified by squares represents results obtained by Example 1, while the curve identified by triangles represents results obtained by Comparative Example A.

The procedure of Example 1 is substantially repeated, except nitrogen gas is not introduced into the anolyte compartments of the cells. The potential of the cathode 218 is also shown on FIG. 6 by the curve identified with triangles. FIG. 6 illustrates that without use of the nitrogen stripping gas, the cathode reaches its corrosion potential, with respect to ruthenium dioxide, of about +0.1 volts in about 65 minutes. FIG. 6 shows that use of a nitrogen stripping gas flow almost entirely reduces the positive shift of the cathode toward its corrosion potential.

EXAMPLE 2

Use of a Stripping Gas in Commercial-Scale Chlor-Alkali Cells

A stack of 54 rectangular membrane chlor-alkali cells is provided for this example. The stack is comprised of cell elements measuring about 1.5 meters by about 3.7 meters which are assembled in a filter press type arrangement as generally described in U.S. Pat. No. 4,756,817. Each cell element comprises a frame member with electrodes held thereto, one side of the electrode having an anode consisting of oxides of titanium, ruthenium and iridium and the other side having a cathode consisting of oxides of ruthenium and nickel. The cell elements employed are substantially similar to those described in U.S. Pat. Nos. 4,488,946; 4,604,171 and 4,666,579. A membrane of a hydraulically-impermeable, cationically-permselective material similar to that described in U.S. Pat. No. 4,358,547 is positioned between the frame members of adjacent cell elements, thereby forming an alternating series of anolyte and catholyte compartments. The general operation of such a cell stack is described in U.S. Pat. No. 4,822,460.

A sodium chloride brine is supplied to the cells by a 15.2 centimeter inside diameter titanium metal anolyte inlet manifold (a large pipe commonly referred to as a "header") having 25 millimeter outside diameter perfluorinated ethylene-propylene copolymer ("FEP") piping attached thereto. The FEP piping conveys brine solution to an anolyte inlet port located at the bottom of each cell element. A similar manifold and FEP piping conveys a two-phase flow of chlorine gas and spent anolyte solution from each cell through an anolyte outlet port located at the top of each cell element. Similar piping conveys water to a catholyte inlet port at the bottom of each cell element, with a two-phase flow of hydrogen gas and aqueous sodium hydroxide solution being removed from the cells through catholyte outlet piping located at the top of each cell element. The manifolds having a two-phase flow therein convey the respective two-phase flow to a separate gas disengagement tank wherein the gaseous phase is separated from the liquid phase. A portion of the spent anolyte solution separated in this fashion is thereafter recycled back to the cell stack. Such membrane cell stacks are generally known in the art and a more detailed description of the cell stack employed in this example is not necessary to understand the present invention.

A nitrogen stripping gas is conveyed to the cell stack, during periods in which normal positive current flow to the cells is interrupted, through use of the sparging apparatus previously described herein and as illustrated by FIGS. 1, 2 and 3. The sparging apparatus is fabricated from a 19 millimeter outside diameter titanium metal tube which has a length that substantially corresponds to the width of the cell stack. One end of the tube is sealed with a titanium metal cap to provide a closed end. There are 54 round holes, each having a diameter of 1.19 millimeters, that are drilled into the tube with a 6.99 centimeter on-center spacing between adjacent holes. The on-center spacing arrangement positions each hole in close proximity to the location where fresh brine exits the anolyte inlet manifold through the FEP piping. A nitrogen gas source is provided which supplies the gas to the sparging apparatus at a pressure of 140 kPa gauge pressure.

The cell stack is operated for a two week period under operating conditions typical for electrolysis of sodium chloride brine solutions in membrane cells. Average steady state operating parameters for the stack are a current density of 4000 $A/m^2$, a catholyte temperature of 90° C., a 33% by weight concentration of sodium hydroxide in the catholyte, a cell voltage of 2.92 volts, an anolyte inlet manifold pressure of 124 kPa gauge pressure and a sodium hydroxide current efficiency of 93%. The sodium chloride brine being electrolyzed has a sodium chloride content of 20% by weight and is an aqueous mixture of recycled anolyte solution and fresh sodium chloride brine solution.

During the two week period, normal current flow to the stack is terminated on four separate occasions. The period of time in which the stack is off-line on these occasions ranges from about 1 hour to about 8 hours. In each instance, an auxiliary rectifier provides a residual current flow of between 1.9 to 15.5 $A/m^2$ of cathode projected surface area through the cell stack. The residual current flow is controlled such that an average cell voltage of at least 1.8 volts is maintained during the off-line periods. The auxiliary rectifier is connected in parallel to a main rectifier which supplies the cell stack with electrical power during normal operation. The auxiliary rectifier is connected in series with respect to the cell stack. The auxiliary rectifier is designed to provide a continuous residual current flow to the cell stack during both normal operation and when the main rectifier is not energized.

During the off-line periods, the anolyte compartments of each cell are flushed with the brine solution being electrolyzed. In each instance, the flow of the sodium chloride brine being electrolyzed in the cell stack is reduced, but not completely discontinued, such that the anolyte inlet manifold pressure is reduced to approximately 35 kPa gauge pressure. The sodium chloride brine is supplied to the cell stack during the off-line periods at a rate of 20 liters per minute for each cubic meter of anolyte solution in the cell stack.

During each off-line period, a nitrogen stripping gas flow is provided at a rate of 50 standard liters of nitrogen per minute for each cubic meter of anolyte solution in the cell stack. The nitrogen stripping gas flow is initiated through the sparging apparatus after the anolyte inlet manifold reaches a pressure of 35 kPa gauge pressure. In each instance, the nitrogen gas flow is initiated approximately 5 minutes after termination of the normal positive current flow. The nitrogen stripping gas flow is maintained until the cell stack is re-energized and the anolyte inlet manifold reaches a pressure of 35 kPa gauge pressure.

After resuming normal steady state operation, in each instance, the average cell voltage remains at 2.92 volts thereby indicating that substantially no electrocatalyst is lost by cathode corrosion during the off-line periods.

EXAMPLE 3

Use of Cathodic Protection and Soluble Reducing Agents to Control Reverse Current Flow and Cathode Corrosion in Electrolytic Cells Two of the cells described in Example 1 are employed in this example. The cells are initially operated in series and substantially under the conditions as stated in Example 1. Thereafter, normal current flow to the cells is discontinued by adjusting the rectifier to provide a residual current flow, i.e., a level equivalent to use of cathodic protection, of approximately 10 amps per square meter of cathode projected surface area. The residual current maintains the cell voltage at 2.0 volts. The immersion heaters for both cells are inactivated when the residual current flow is initiated.

After termination of the normal current flow, the sodium chloride brine solution used during electrolysis having a sodium chloride concentration of 25% by weight and a pH of 11 is introduced through the anolyte inlet ports to flush the anolyte compartments of the cells. The flow rate of the sodium chloride brine to each cell is maintained at 6 cubic centimeters per minute, or in other terms 40 liters per minute for each cubic meter of anolyte solution, until the cell temperature reaches about 30° C.

Upon reaching this temperature, the sodium chloride brine is replaced by a sulfite-containing brine. The sulfite-containing brine is obtained by adding sodium sulfite, a soluble reducing agent, to the previously described alkaline brine solution in an amount sufficient to yield a sulfite concentration of 0.11% by weight. The sulfite-containing brine solution is thereafter introduced to each cell at a flow rate of 6 cubic centimeters per minute, or in other terms 40 liters per minute for each cubic meter of anolyte solution, for about 60 minutes. Thereafter, the residual current flow to the cells is terminated and the two cells are connected as previously described in Example 1 and illustrated by FIG. 5 to simulate reverse current flow. The cathode potential of the first cell is measured as in Example 1 and the results are provided in FIG. 7. The curve identified by the line having squares thereon illustrates the results obtained by Example 3. The results indicate that introduction of the soluble reducing agent substantially reduces the positive shift of the cathode toward its corrosion potential when compared to results obtained for Comparative Example A.

After maintaining the sulfite-containing brine flow for about 20 hours, the cell catholyte solution is sampled and analyzed by inductively coupled, plasma optical emission spectroscopy, a well-known analytical method, for corrosion products containing ruthenium. The analysis indicates the absence of such ruthenium-based corrosion products. The analysis has a detection limit of 0.5 parts per million of ruthenium.

EXAMPLE 4

Figure 7:
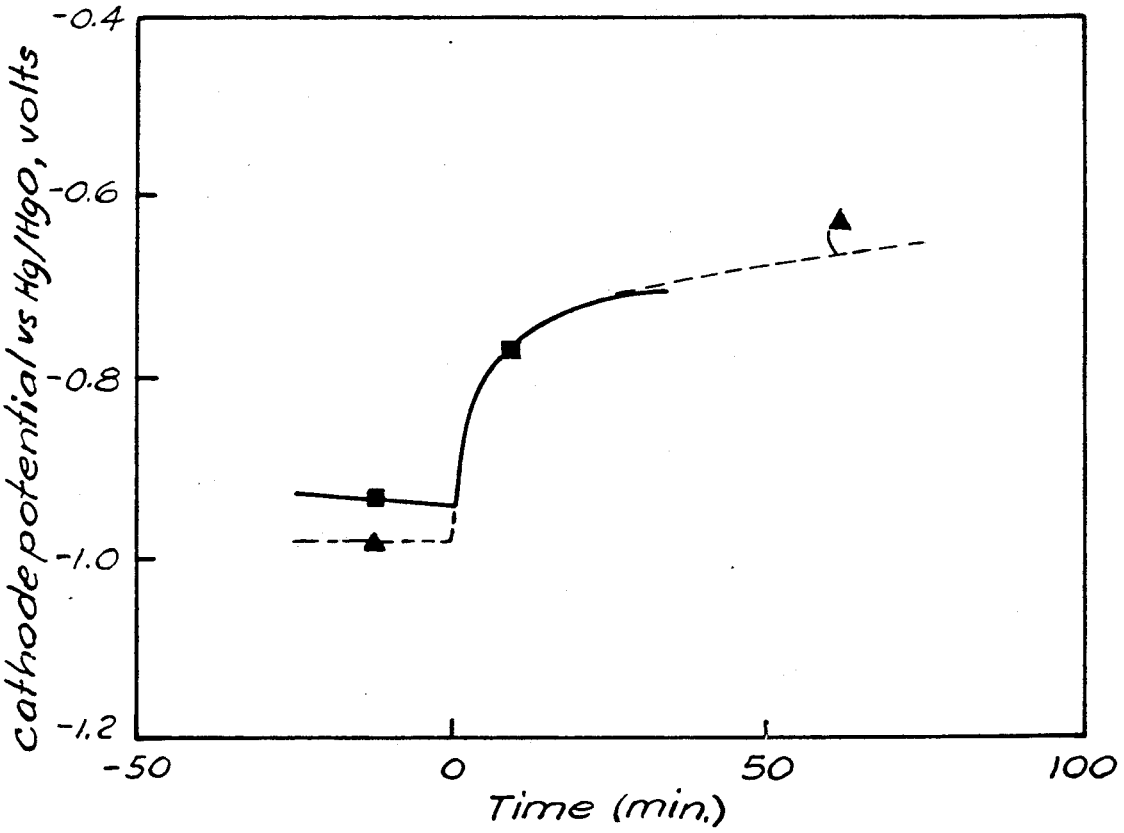
FIG. 7 is a graph of cathode potential, as measured in volts using a mercury/mercuric oxide reference electrode, versus time, in minutes, for Examples 3 and 4. The curve identified by squares represents results obtained by Example 3, while the curve identified by triangles represents results obtained by Example 4.

The procedure of Example 3 is substantially repeated, except the sulfite-containing brine has a sulfite concentration of about 0.54% by weight of the solution. The cathode potential is measured as in Example 1 and is also illustrated in FIG. 7. The curve represented by the line having triangular shapes thereon illustrates the results obtained by Example 4. The results indicate that introduction of the soluble reducing agent in a larger amount, when compared to Example 3, produces roughly the same effect with respect to control of reverse current flow. The cell catholyte solution is also sampled and analyzed as in Example 3 for ruthenium-based corrosion products. The analysis indicates the absence of ruthenium-based corrosion products in the catholyte solution.

Similar results are obtained from other embodiments of the invention as previously described herein.

What is claimed is:

1. A sparging apparatus for distributing a stripping gas flow to a plurality of anolyte compartments in a stack of membrane electrolytic cells to control reverse current flow, the apparatus comprising:

an anolyte inlet manifold defining a chamber through which a flow of anolyte solution is conveyed to the anolyte compartments during normal cell operation, the anolyte inlet manifold having an interior surface with a plurality of inlet ports located on said surface, each inlet port defining a passage between the chamber and an anolyte compartment;

a porous conduit having an inlet end and a closed end, the porous conduit positioned within the chamber such that the stripping gas flow is conveyed from the porous conduit to the anolyte compartments through the inlet ports;

means for securing the porous conduit within th e anolyte inlet manifold; and means for connecting the inlet end of the porous conduit to a source of stripping gas.

2. The apparatus of claim 1 wherein the porous conduit is fabricated from a material resistant to attack from chemical species present in the anolyte inlet manifold.

3. The apparatus of claim 1 wherein the porous conduit is fabricated from a material selected from the group consisting of titanium, tantalum, zirconium, niobium, tungsten, and alloys thereof.

4. The apparatus of claim 1 wherein the porous conduit is fabricated from a material selected from the group consisting of polytetrafluoroethylene, perfluorinated ethylene-propylene copolymer and perfluorinated ethylene-vinyl ether copolymer.

5. The apparatus of claim 1 wherein the porous conduit comprises a cylindrical tube having a plurality of perforations therein.

6. The apparatus of claim 5 wherein the perforations are substantially round holes having a diameter of from about 0.5 millimeters to about 5 millimeters.

* * * * *